US006783386B2

(12) United States Patent
Clement

(10) Patent No.: US 6,783,386 B2
(45) Date of Patent: Aug. 31, 2004

(54) STRAIN RELIEF DEVICE FOR AN ELECTRICAL CONNECTOR FOR HIGH FREQUENCY DATA SIGNALS

(75) Inventor: Jean-Yves Clement, Saint Jeannet (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/453,948

(22) Filed: Jun. 4, 2003

(65) Prior Publication Data

US 2004/0038582 A1 Feb. 26, 2004

(30) Foreign Application Priority Data

Aug. 22, 2002 (EP) ..... 02368092

(51) Int. Cl.[7] ..... H01R 13/58
(52) U.S. Cl. ..... 439/467
(58) Field of Search ..... 439/409, 410, 439/417, 467

(56) References Cited

U.S. PATENT DOCUMENTS 5,445,538 A 8/1995 Rodrigues et al. ..... 439/460
5,766,040 A 6/1998 Naerland et al. ..... 439/608
5,895,292 A 4/1999 Affeltranger ..... 439/610
6,077,122 A * 6/2000 Elkhatib et al. ..... 439/608
6,315,596 B1 * 11/2001 Chen ..... 439/417
6,402,541 B1 * 6/2002 Mindeau ..... 439/402

* cited by examiner

*Primary Examiner*—Renee Luebke
*Assistant Examiner*—Ann McCamey
(74) *Attorney, Agent, or Firm*—David R. Irvin; John R. Pivnichny

(57) ABSTRACT

A strain relief device for an electrical connector designed to be interconnected to another connector of the same type to connect cables containing at least one twisted pair for the transmission of very high-frequency differential data signals. Conductors are connected in a connection block by insulation displacement contacts to contact blades, adapted to ensure contact in an interface block with the corresponding contact blades of the other connector. The device has two guillotines sliding in side grooves of the connection block. The side edges of the guillotines form a 90° angle between them and a 45° angle in relation to the direction of movement during the clamping operation, such that the side edges of the guillotines form a diaphragm when they approach one another, thereby ensuring a 360° seal preventing the cable from being deformed or damaged.

11 Claims, 8 Drawing Sheets

STRAIN RELIEF DEVICE FOR AN ELECTRICAL CONNECTOR FOR HIGH FREQUENCY DATA SIGNALS

FIELD OF THE INVENTION

The present invention relates generally to electrical connectors terminating cables that include twisted and shielded pairs of conductors, and relates in particular to a strain relief device for an electrical connector for high frequency data signals.

BACKGROUND

Electrical shielded data connectors are commonly employed to terminate signal-carrying, jacketed, multi-connector electrical shielded cables. Such cables are often used to connect various components of a data communication system. Each such data connector has a connector housing which supports a plurality of insulation displacement contacts (IDC). The individual conductors of the multi-conductor cable are terminated by the contacts for electrical connection. The jacketed cable extends past the connector housing to another component of the system, thereby creating a strain at the point where the cable leaves the housing.

Interconnection depends upon a good termination of the conductors of the cable with the contacts. Consequently, it is necessary to ensure that any strain placed on the jacketed cable is not transmitted to the contact termination. Such a strain could dislodge one or more of the conductors from the contacts, which would result in failure of the connector. Also, good electrical contact between the connector housing and the cable shielding must be ensured in order to provide a smooth transition of impedance. The cable shielding and the connector shielding, when assembled together, must be as close as possible to a metallic tube, with as little leakage as possible. Adequate pressure of the strain relief on the cable shield ensures good electrical contact; unfortunately, too much pressure on the cable bends it out of shape, degrades its transmission performance, and runs the risks damaging the conductors.

The prior art teaches a wide variety of strain relief devices. For example, U.S. Pat. Nos. 5,895,292, 5,766,040, and 6,077,122 show techniques for supporting jacketed cables in connectors. However, these prior art devices include so many parts that they are difficult to assemble. Also, none adequately accommodates a wide range of cable sizes, and none ensures a good electrical continuity of the shield without incurring the risk of over-stressing the cable's conductors. Furthermore, these prior art devices may not protect against both inward and outward movement of the cable in the connector, and may not minimize undesired high-frequency, common-mode voltage induced between the connector housing and the cable shield.

The aforementioned problems are partially solved by the connector described in U.S. Pat. No. 5,445,538, which includes a connector housing defining a first bounded opening to permit passage of the cable. The cable strain relief device includes first and second hermaphroditic strain relief members for securing the cable. The first strain relief member is fixedly positioned within the housing, and the second strain relief member is movably supported with respect to the first strain relief member. The first and second strain relief members define a fully bounded opening surrounding the cable. The first and second strain relief members are movable so as to reduce the size of the seconded bounded opening for securing the cable by friction. Unfortunately, in order to obtain a good tightness resulting in a good electric contact, especially in the direction perpendicular to the direction of moving the second strain relief, it is necessary to tighten this relief member to a maximum, thereby incurring the risk of distorting the cable and finally crushing it.

SUMMARY

Accordingly, an object of the invention is to provide a strain relief device for an electrical connector for high frequency data signals which ensures proper grip of the cable, results in a good 360° seal, and does not deform or damage the cable so as not to degrade its electrical performance characteristics.

The invention includes a strain relief device for clamping an electrical connector designed to be interconnected to another connector of the same type so as to connect two cables. The two cables contain at least one twisted pair for transmitting very-high-frequency differential data signals. The conductors of the pair are connected in a connection block by Insulation Displacement Contacts (IDC) to contact blades, which are adapted to ensure contact in an interface block with the corresponding contact blades of the other connector. The device comprises two guillotines sliding in side grooves of the connection block. The side edges of the guillotines form a 90° angle between them and a 45° angle in relation to the direction of movement of the guillotines during the clamping operation, such that the side edges of both guillotines form a diaphragm when they approach one another, thereby ensuring a 360° seal that prevents the cable from being deformed or damaged.

BRIEF DESCRIPTION OF THE DRAWINGS

The above and other objects, features, and advantages of the invention will be better understood by reading the following more particular description of the invention in conjunction with the accompanying drawings, wherein.

DETAILED DESCRIPTION

Figure 1:
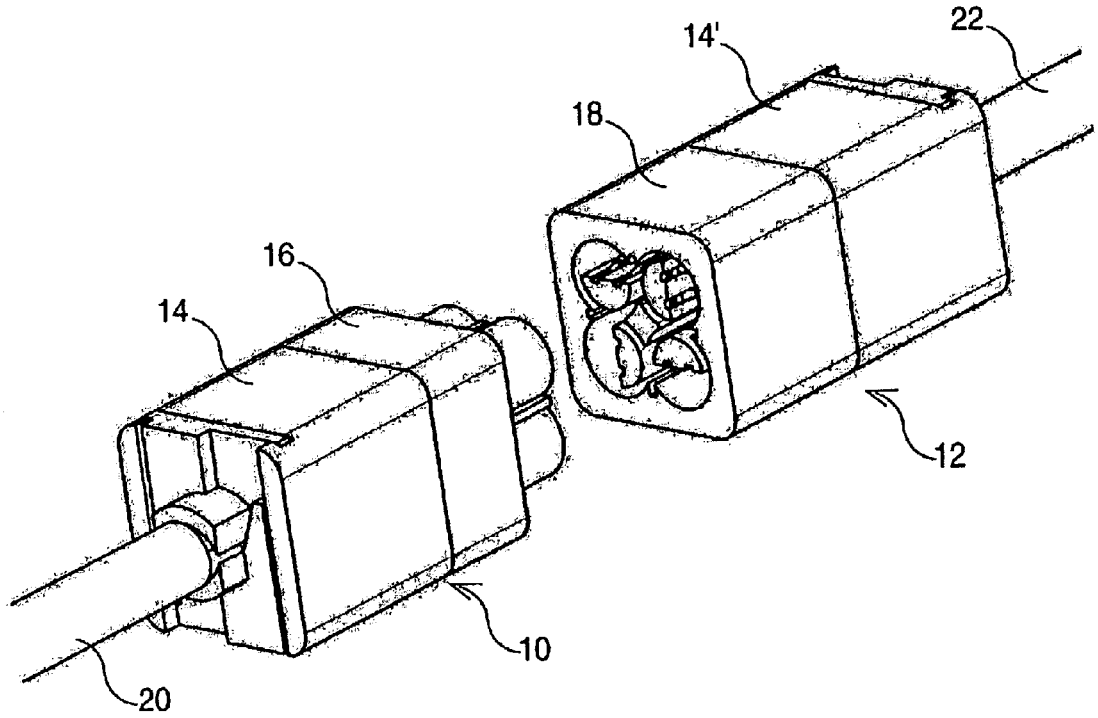
FIG. 1 is a perspective view showing a male connector and a female connector before their connection together.

The connector according to the invention is designed to interconnect with another connector of the same type, but of the opposite gender. In this manner, as shown in FIG. 1, the male connector 10 is adapted to connect with the female connector 12. This type of connector is said to be "semi-hermaphroditic" insofar as, while the connectors are different in their external appearances, they feature hermaphroditic contacts as will be described below.

As compared with hermaphroditic connectors, semi-hermaphroditic connectors have lower manufacturing costs because fewer different kinds of parts need to be made, and thus fewer different molds and cutting tools are needed, and do not require the same precise tolerances to ensure perfect interconnection. Modifying a dimension of one of the two hermaphroditic connectors gives rise to the same modification on the other connector. As a connector includes various elements, managing an interface dimension tolerance change becomes very difficult, especially in the case of multiple sourcing.

On the other hand, when a semi-hermaphroditic configuration is used, as in the case of the invention, the production of golden females, for example, allows different families of male connectors to be produced in different manufacturing locations without influencing the fabrication of the female connectors, and vice versa. Among other considerations, the relative alignment of the common parts, such as the contact supports, is possible by adjusting their positions inside the connector body.

Each connector has a metallic body that includes a connection block 14 or 14' which is used to connect the cable to the connector, and which is identical for each male or female connector, and an interface block 16 or 18, which is different depending on whether the connector is male or female. Both connection and interface blocks may be merged into a single part. In this case, only two different molds, rather than three, are required to manufacture both connectors.

Although the cables 20 and 22, interconnected by connectors 10 and 12 according to the invention, may be multiple-pair cables that are capable of including an arbitrary number of pairs, the cables used in the exemplary embodiment described here have four pairs. In this manner, each connector, whether it is male or female, includes four cylindrically shaped cavities as shown in FIG. 1, in which are located the hermaphroditic contacts designed to ensure the electrical connection between each pair of the male connector and each pair of the female connector.

Figure 2:
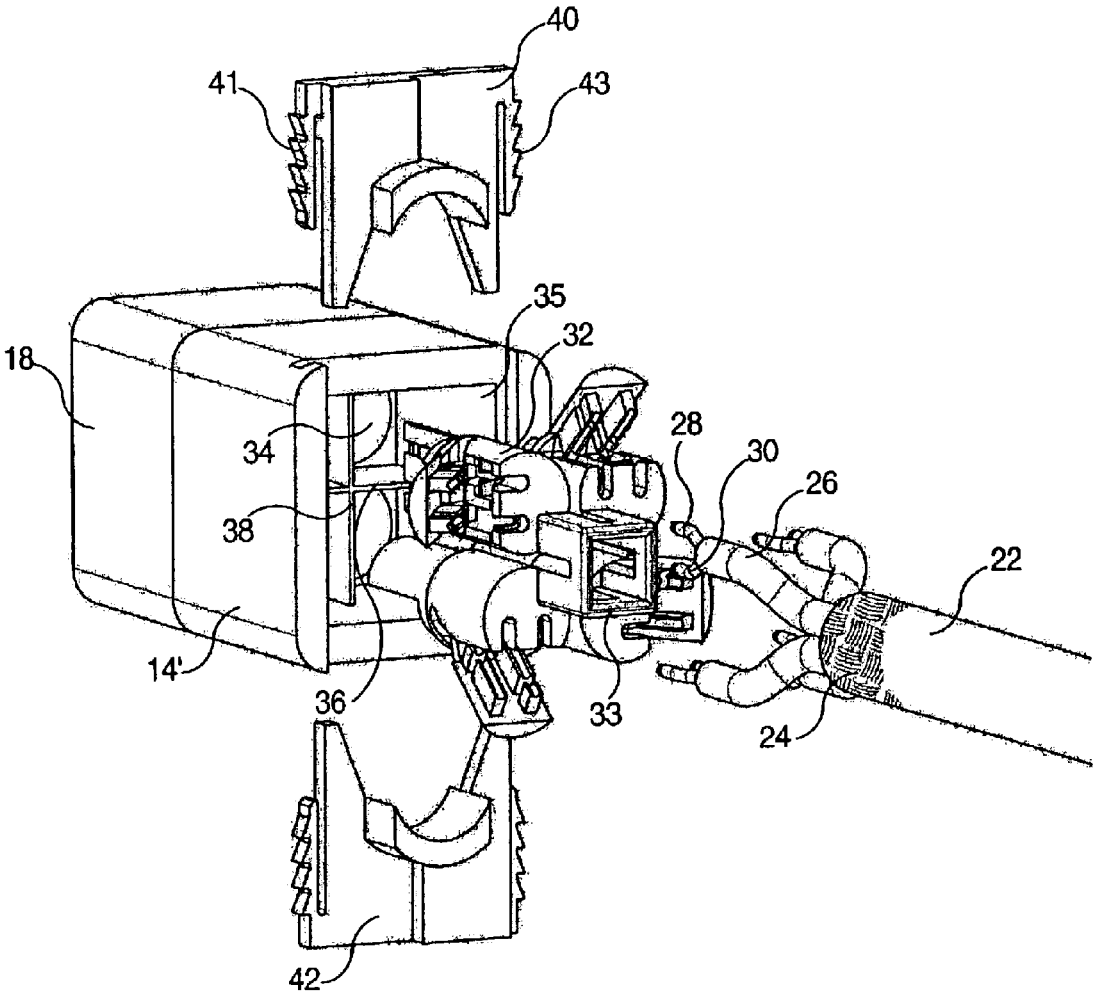
FIG. 2 is a perspective and partially exploded view representing the female connector, the dressing-blocks, and the cable, before the insertion of the conductors of each pair into the IDC.

As shown in FIG. 2, each cable 20 or 22 is first stripped by removing an end part of the outer jacket and the shielding braid 24, so as to separate the four pairs. This shielding ensures that the cable is isolated from external electromagnetic disturbances, and maintains pairs against one another. The conductors 28 and 30 of each pair 26 are insulated by a sheath made of plastic material and twisted together to form the transmission line. The electrical characteristics of the transmission line are determined by geometric parameters such as the diameters of the conductors, the diameters of the insulating material, and the twist pitch. In order to meet high performance criteria, particularly in terms of isolation, each pair is individually shielded. The two conductors 28 and 30 of the pair are then connected to the connector's contacts by means of a dressing-block 32.

It should be noted that the four dressing-blocks 32 may be molded in one single piece, two parts, or four separate parts. In the embodiment described with reference to FIG. 2, they are single pieces held together by an optional support 33.

The connection block 14' (as all the connection blocks) has four cylindrical cavities 34 designed to receive the dressing-blocks 32, and a cavity 35 in front of the connection block designed to house the four pairs of conductors, still wrapped in their individual shielding. The cavity 35 is divided halfway along its depth into four insulating sub-cavities by two orthogonal conducting walls 36 and 38. These walls ensure the transition of the shielding between the part of the cable where the individual shielding of the pairs is in mutual contact (a location where the pairs are well insulated by their insulating sheaths) and the part where the pairs are separated and the individual shielding stops. The rear of the connection block is closed by two diaphragm-type guillotines 40 and 42, which will be described below, which ensure both electrical continuity (ground connection) and a good seal against external contaminants by exerting pressure on the cable shielding.

Figure 3:
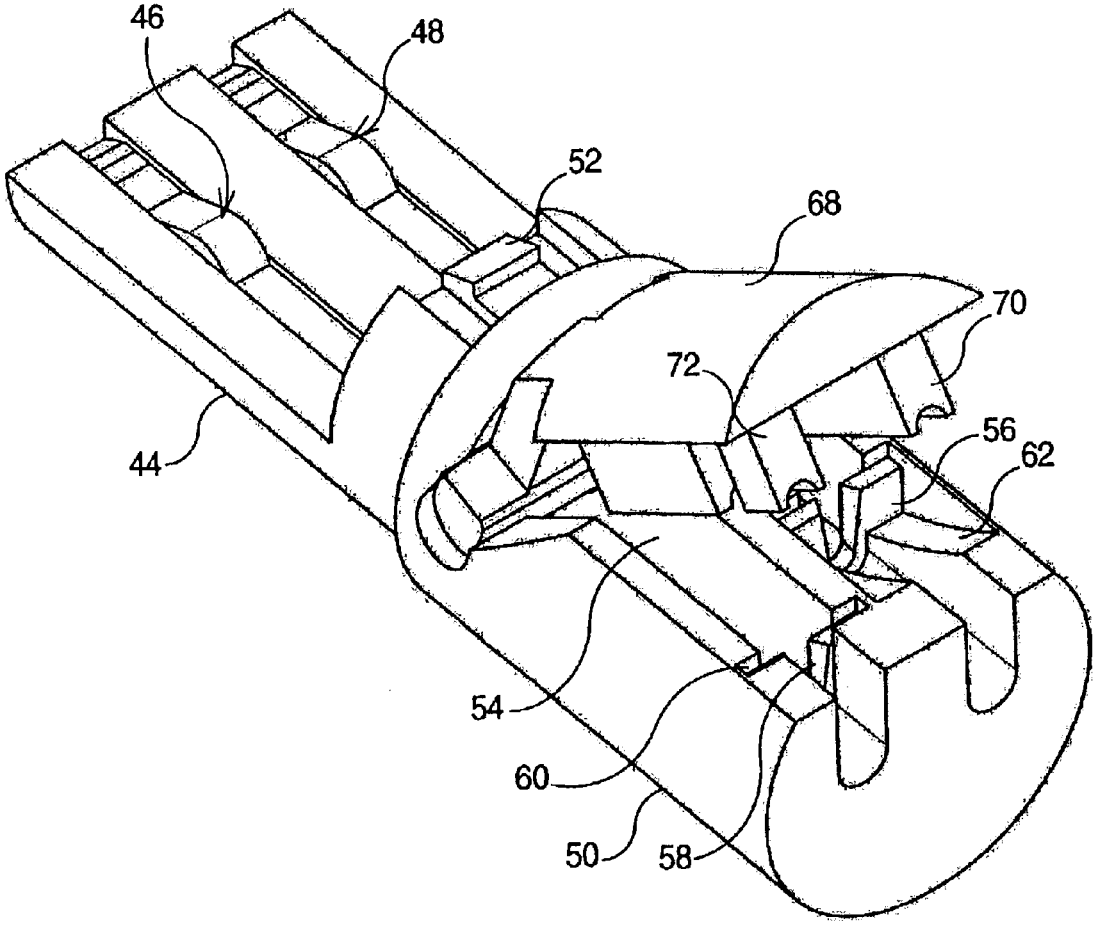
FIG. 3 is a perspective view of a dressing-block in which the closing lever has been raised before the insertion of the conductors of the pair.

Each dressing-block 32, as illustrated in FIG. 3, has a front part 44 made of plastic, which supports the two contact blades 46 and 48 designed to ensure the connection with the other connector of opposite gender, and a rear part 50 also made of plastic, which is used to connect the two conductors of the pair by traditional IDC (Insulation Displacement Contact). When the connection is complete for the four dressing-blocks, the assembly is fully inserted into the connection block of the connector until the catch 52 for each dressing-block locks the assembly in the connector. In this position, the front parts 44 of the dressing-blocks are located inside the connector's interface block, and the rear parts 50 are located in the cylindrical cavities 34 of the connection block (see FIG. 2). The cylindrical cavity 34, which extends to the end of the interface block, has the same geometric characteristics over the entire length of the connector so as to maintain the same electrical characteristics.

Figure 4A:
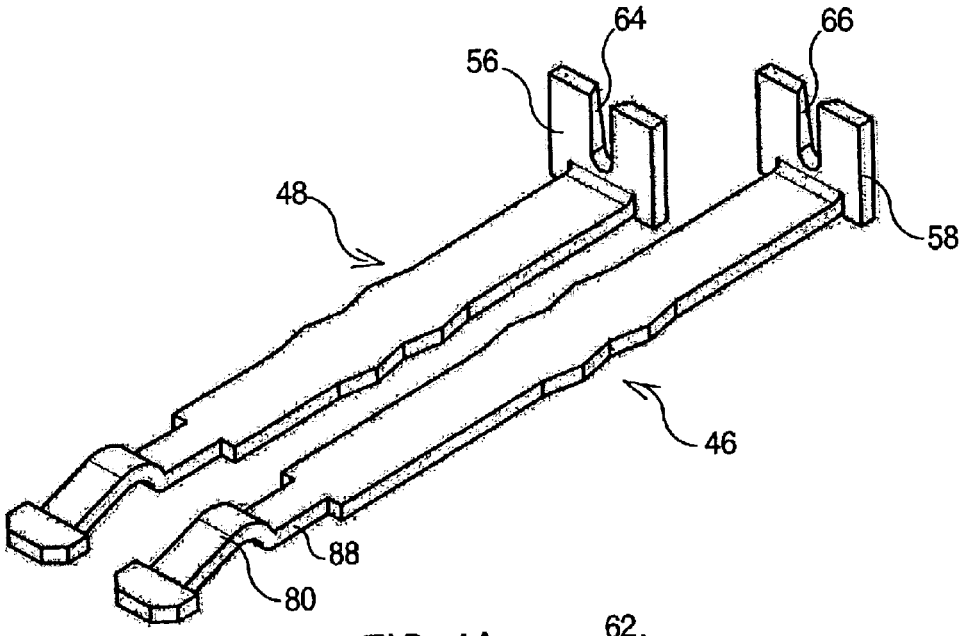
FIGS. 4A and 4B represent a perspective view of the contact blades and the dressing-block without its closing lever, before the insertion of the blades into the dressing-block.
Figure 4B:
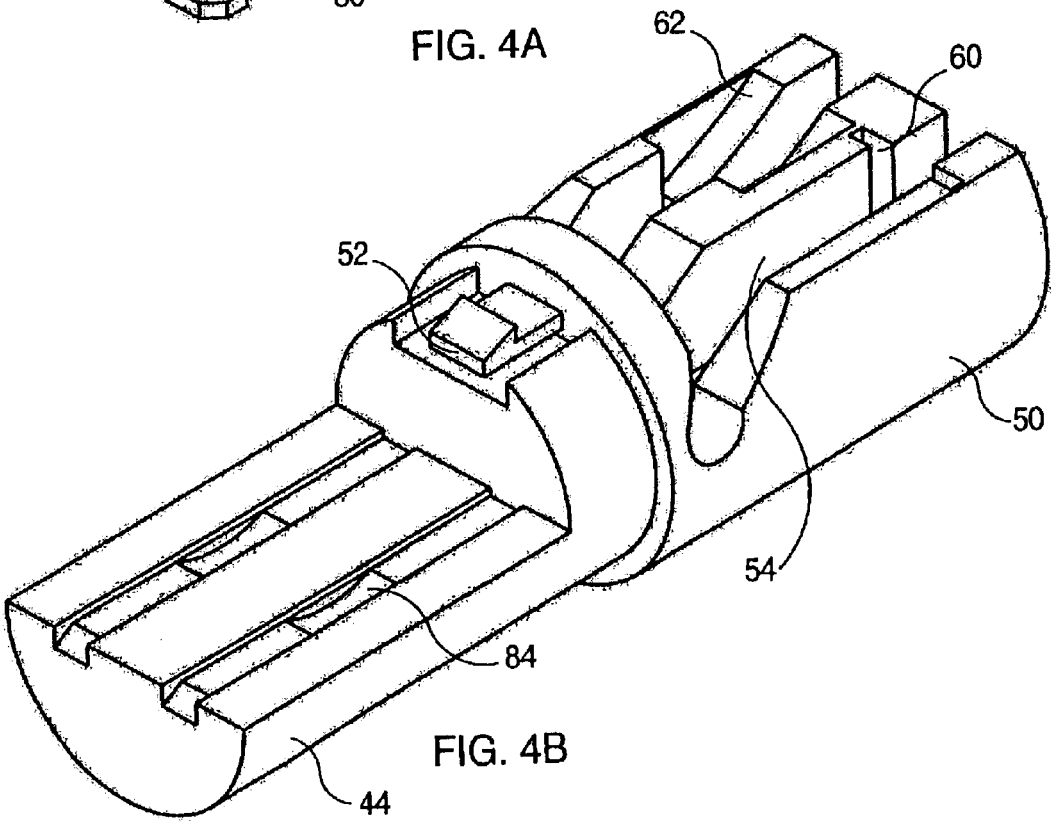

The rear part 50 of each dressing-block has two slides 54 into which the two contact blades 46 and 48 are introduced. FIGS. 4A and 4B show the dressing-block and the contact blades which have not yet been inserted into the dressing-block. Contact blade 48 is shorter than contact blade 46 because the lengths of IDCs 56 and 58 are chosen to prevent them from being placed side by side, in order to prevent them from coming into contact, which would be possible if both blades were the same length. In the latter case, in order to prevent contact, a space would be required between the contact blades which would be excessive, in order to preserve the electrical parameters of the line.

When the connection is made, each IDC is introduced into its respective slide, such as the slide 60 for the IDC 58 visible in FIG. 4B (the slide in which the IDC 56 is inserted is not visible in the figure). The dressing-block may have a chamfer 62 at the front of the slide intended to receive the IDC 56, the purpose of which is to introduce the contact blade 48 without permanently distorting it.

In order to ensure that each conductor of a pair is connected, these conductors are introduced into the slides 54, whose lengths are calculated so that the vertical cutting sides 64 or 66 make solid contact with the insulation of each conductor. The pair is introduced into the dressing-block so that its shielding 26 (see FIG. 2) comes into contact with the rear of the dressing-block body, which ensures the continuity of the shielding with the cylindrical cavity 34. In the embodiment described here, the IDCs form an integral part of the contact blades.

The dressing-block has a closing lever 68, rotating around a pin, which is lowered when the pair is introduced into the dressing-block. When lowered, the lever 68 forces the conductors to enter the IDCs 56 and 58. The IDCs slit the insulation by their sharp vertical sides 64 and 66 and penetrate into the conductor's copper, thus ensuring a durable electrical contact. This easy and rapid procedure enables connection operations to be performed at sites where local networks are being installed. The lever closing operation is repeated on the four dressing-blocks before the assembly is inserted into the connector as described previously. The closing lever has retaining elements such as elements 70 and 72, the lower portion of which has a semicircular profile in order to exert a retaining force on the conductors in the slides 54 when the closing lever is pressed downward.

The connector described above is designed to comply with the transmission characteristics of a pair-shielded cable as closely as possible. As such, it has cylindrical cavities 34 (see FIG. 2) and extension 74 (see FIG. 5A) so as to maintain a more constant distance between the conductors and the ground of the connector's ground. This type of geometry improves the linearity of the differential mode impedance between the two conductors as well as the impedance between the conductors and the shielding of the connector (common mode impedance), which is not the case when there are sharp angles and planes at 90° which require the high frequency return currents to change directions in the conductor body of the connector.

The continuity between the circular type geometry of the connection block and the circular type geometry of the interface block is important to the inventive connector. This continuity reduces the interface's return loss and thus reduces the attenuation, which has become a crucial parameter in terms of current standards activities (category 8 of the ISO standards) applied to transmission frequencies above 600 MHz, which frequencies may exceed 1.2 Ghz.

Figure 5A:
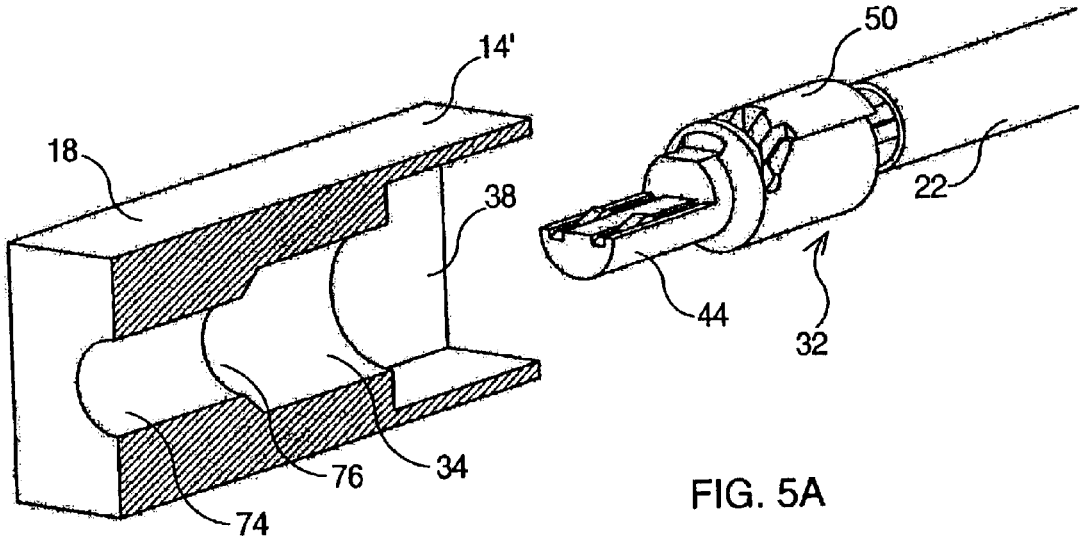
FIGS. 5A and 5B represent a longitudinal section of the connector cavity showing the inside cavities and the dressing-block connected to the cable, before and after the insertion of the dressing-block into the connector.
Figure 5B:
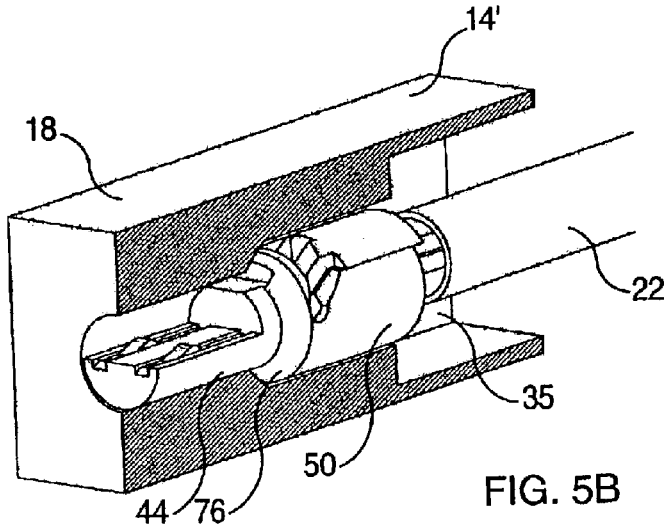

The description now refers to FIGS. 5A and 5B which represent the longitudinal section of the connector showing the cavities into which the dressing-block and contact blade assembly are integrated, both before and after the insertion of this assembly into the connector. The cylindrical cavity into which the dressing-block 32 is inserted is terminated by a first cylindrical cavity having a circular section of small diameter 74 into which the front part 44 of the dressing-block is incorporated, and which is located in the interface block, and a second cylindrical cavity with a circular section of larger diameter 34 in the same axis as the first cavity. This portion of larger diameter 34 is located inside the connection block and is designed to receive the rear portion 50 of the dressing-block. Both cavities 34 and 74, while having different diameters in the embodiment described here, may instead have the same diameter. The important point is that their geometry must be the same (concentric cylindrical shapes) and that they have the same proportions as the conductors. In addition, the transition zone 76, which has the shape of a truncated cone in this embodiment, should not have sharp angles, so that it does not disturb the return currents circulating in the body of the connector and cause the generation of parasitic reflections.

In order to ensure the best possible geometric continuity, the cable 22 should be mounted in the connection block so that the shielding of each pair of conductors 26 ends up in the second cylindrical cavity 34, where the connection takes place. In this manner, as regards the transmission, the environment that the pair will encounter in the cavity 35 (where the wall 38 is located) which is not cylindrical will have no influence on the electrical parameters. For this reason, the walls 36 and 38 of the cavity 35 (see FIG. 2) are not involved in the transmission parameters, although they are designed to isolate the pairs from one another in order to reduce diaphony.

The geometric continuity of the connector described above is designed to obtain an important characteristic of the invention, wherein the differential mode impedance of the twisted pair derived from the cable is equal to the differential mode impedance of the connector, particularly in the area of the contact blades.

The differential mode impedance of a twisted pair is equal to:

$$Z_{pd} = \frac{120}{\sqrt{\varepsilon r}} \mathrm{Ln}\left(X \cdot \frac{b^2 - s^2}{b^2 + s^2}\right)$$

where Ln stands for neperian logarithm, er is the relative permittivity, b is the inside diameter of the shield (shielding), s is the distance between the centers of the conductors, and X=2s/d where d is the diameter of the conductors. The value of the impedance is thus determined by the cable. The dimensional parameters of the connector after the IDC are adapted so that the value of the differential mode impedance of this part of the connector is the same. This is enabled by the geometric continuity of the invention, whereas this equality cannot be provided by connectors according to the prior art, which do not provided the needed continuity.

The same is true concerning the common mode impedance of the twisted pair, which is equal to the common mode impedance of the connector, particularly in the area of the contact blades. For the twisted pair, this impedance is equal to:

$$Z_{pc} = \frac{60}{\sqrt{\varepsilon r}} \mathrm{Ln} A . \frac{b}{d}$$

where A is an experimental coefficient having a value between 1 and 2.

Figure 6:
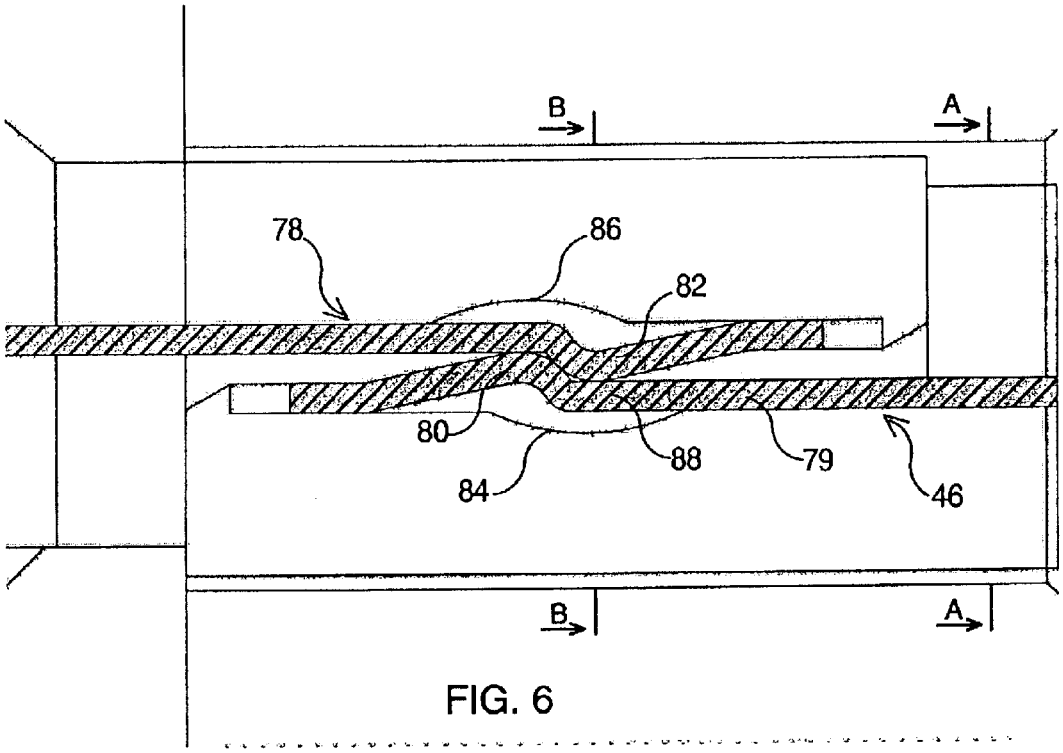
FIG. 6 is a longitudinal section of the contact blades of the male and female connectors in contact with each other after the two connectors have been connected.

With reference to FIG. 6, the contact between a male connector and a female connector is ensured by a contact blade 46 in the first connector and a contact blade 78 in the second connector. These blades are identical in shape as mentioned previously. In each connector, the contact blade is connected to the sharp part of the IDC, for example the sharp part 66 of the IDC 58 for the contact blade 46. It is placed in a groove of the front part 44 of the dressing-block (see FIG. 4B) and has teeth to hold it in place in the groove (see FIG. 4*a*).

Each contact blade, such as blade 46, after a rectilinear portion 79, has a stiff side terminated by a rounded bump 80 for the blade 46 or 82 for the blade 78, and a slightly inclined plane terminating at the end of the blade. When the interface block of the male connector is inserted into the interface block of the female connector, the two slightly inclined planes come into contact while exerting a slight resistive force. The blades deform while forcing the rounded bumps into recesses 84 or 86 provided for this purpose at the base of the groove where the blade is located. Once the rounded bump of each blade has passed to the other side of the rounded bump of the other blade, the two blades return nearly to their initial shape and are in auto-latching contact with one another on their stiff sides. This mechanism has the advantage of enabling each pair of contacts to be retained individually without requiring any other mechanical locking. This way, a connector provided with only one or two pairs instead of four can be manufactured. An added advantage is that the connectors are unlocked if the plug is accidentally pulled out without damaging the jack or the wall support.

Once again with reference to FIG. 4A, it can be seen that the contact blade 46 is wider along its rectilinear part 79 than at its end where the contact is made, which end comprises a rectilinear part 88, the stiff side, the rounded bump 80 (location of the actual contact), and the inclined plane. This provides electrical continuity as explained below.

Figure 7A:
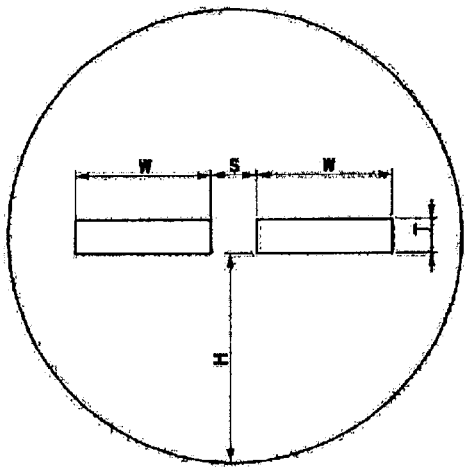
FIGS. 7A and 7B represent, respectively, a cross-section of the connector showing the rectilinear part of the blades and a cross-section of the connector showing the contact between the contact blades of the two connectors.
Figure 7B:
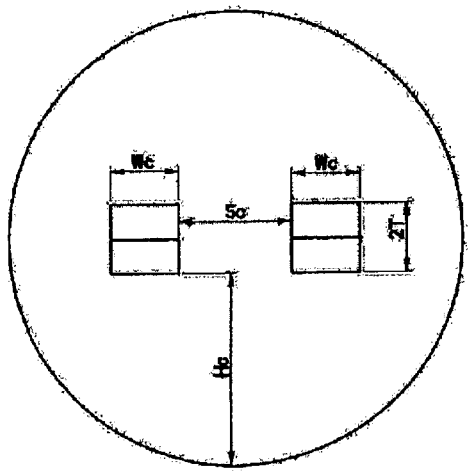

Reference is now made to FIGS. 7A and 7B which represent cross-section A of the connector showing the single blade 46 in the rectilinear part (see FIG. 6) and cross-section B of the interconnection at the point of contact between the rectilinear part of the blade 46 and the bump 82 of the blade 78 of the other connector, respectively (see FIG. 6). These figures clearly show that while the thickness T of each blade remains constant, its width shifts from W in its rectilinear part to Wc at the contact point.

When taking into consideration the approximations justified by the geometric characteristics commonly used in this technology, the common mode impedance of the contact blades in relation to the shielding cavities is given by the following formula:

$$Z_{cc} = \frac{60}{\sqrt{\varepsilon r}} \mathrm{Ln}\left(\frac{1.9B}{0.8W + T}\right)$$

where B=2H+T is the distance between the reference ground planes, that is to say between the opposite walls in the cavity.

As seen previously, the values of the dimensional parameters W and T are selected so that the common mode impedance of the contact blades is equal to the common mode impedance of the twisted pair, that is:

$$Z_{cd}=Z_{pc}$$

It should be noted that the differential mode impedance of the contact blades between themselves, which is equal to the differential mode impedance of the twisted pair, is given by:

$$Z_{cd} = 2Z_{cc}\left(1 - 0.347e^{-2.9\frac{S}{B}}\right)$$

At the contact point illustrated by FIG. 7B, where the thickness becomes 2T, a different width Wc is required to maintain a constant common-mode impedance. To do this, the following equation must be true:

$$0.8\ Wc+2T=0.8\ W+T,$$

which simplifies to:

$$Wc=W-1.25T$$

The differential mode impedance of the contact blades remains essentially constant, as the only parameter which varies is:

$$1 - 0.347e^{-2.9\frac{S}{B}}$$

although this variation is very low due to the fact that S is replaced by Sc.

Closure of the cable side connector is ensured by two guillotines 40 and 42 mentioned above (see FIG. 2). These two guillotines slide in two side grooves made in the connector body, and may be pre-positioned in their respective housings when the connector is manufactured without disrupting the assembly of the connector with the cable. Once the assembly operation is completed, the two guillotines are pressed together using a pair of parallel pliers in order to close them onto the shielding braid 24 of the cable 22. It is thus important that the guillotines, which are made of conductive material, be in electrical contact with the cable shielding, to ensure the continuity of the shielding. In order to do this, the braid 24 can be folded back onto the outer jacket of the cable, or a sufficient length of the outer jacket may be removed from the cable so that the guillotines can press on the braid and the film of the four pairs.

Figure 8A:
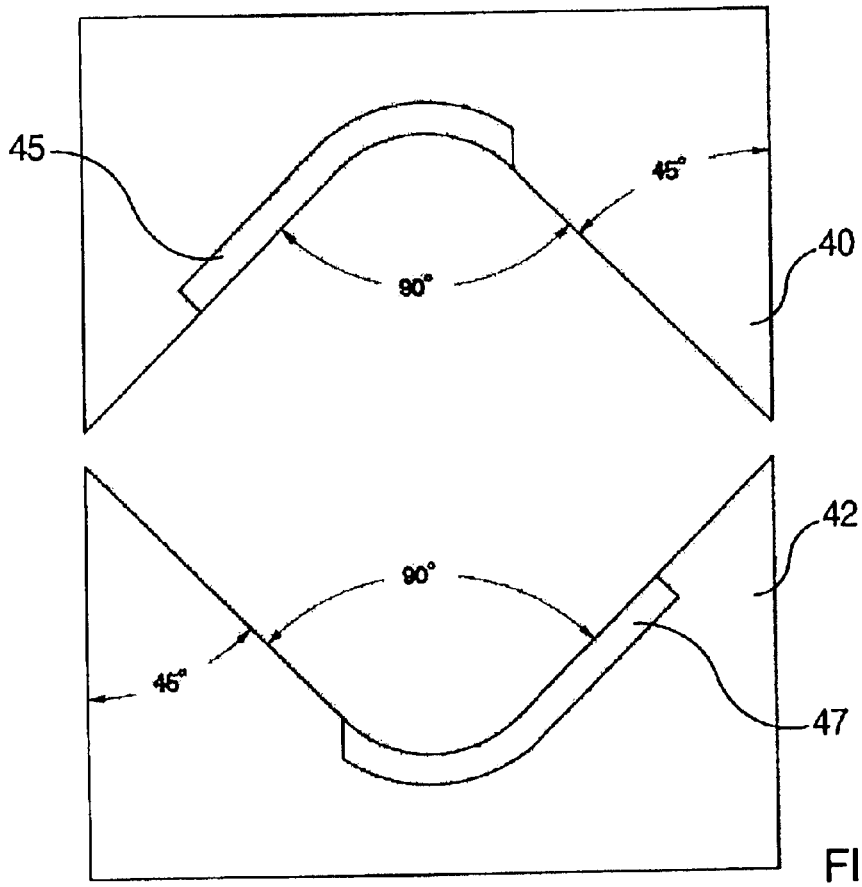
FIGS. 8A and 8B represent, respectively, two positions of the guillotine mechanism in a first embodiment for the clamping of the cable.

When clamped using pliers, the guillotines 40 and 42 initially have the positions shown in FIG. 8A. As the clamping operation progresses, the guillotines are retained by racks located on the sides of the guillotine, such as racks 41 and 43 of the guillotine 40 visible in FIG. 2. When clamping is complete, the guillotines are in the positions shown in FIG. 8B. The racks ensure that the cable is adequately held at all times, regardless of its diameter.

The guillotine mechanism is an important characteristic of the invention. All systems designed to retain a cable in a connector have long encountered common problems of ensuring a proper grip, providing a good 360° seal, and ensuring that the cable is not deformed so as not to downgrade its electrical performance characteristics or to short-circuit the pairs. The mechanisms used in the prior art generally feature a fixed geometry, however, and thus have the dilemma of correctly maintaining the cable while crushing it, or not deforming the cable at the expense of a poor seal, poor electrical contact, and poor recovery of the stresses endured by the cable. The present invention solves the aforementioned long-standing problems by providing the guillotines with side edges forming a 90° angle between them and a 45° angle in relation to the direction of guillotine movement during the clamping operation. When the guillotines of the present invention come together to shift from the position illustrated in FIG. 8A to the position illustrated in FIG. 8B, the cable entry hole reduces both vertically and horizontally, and the two side edges form a diaphragm as they approach. In this manner, the cable is clamped uniformly on four sides, which prevents it from being crushed.

Figure 8B:
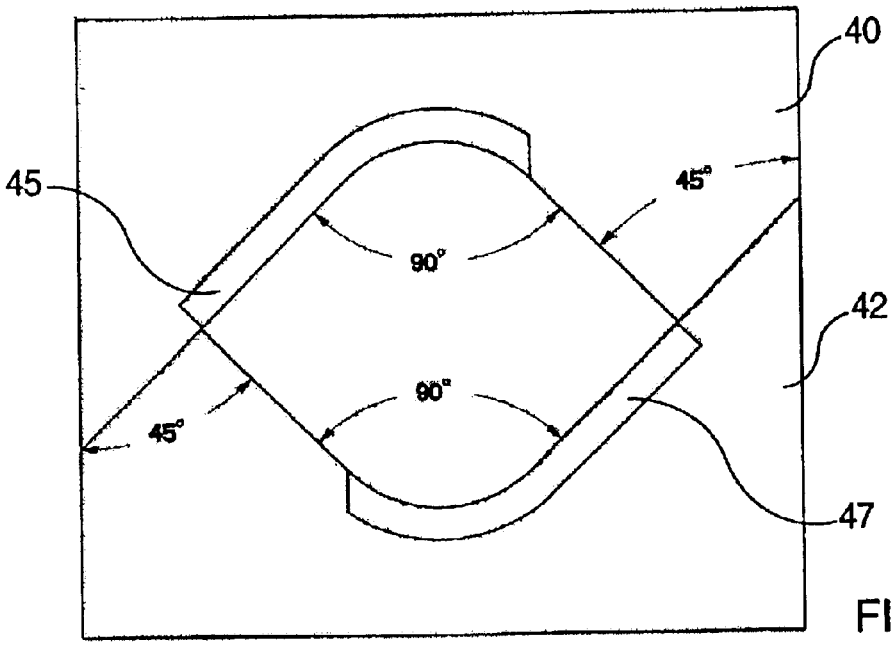
Figure 9:
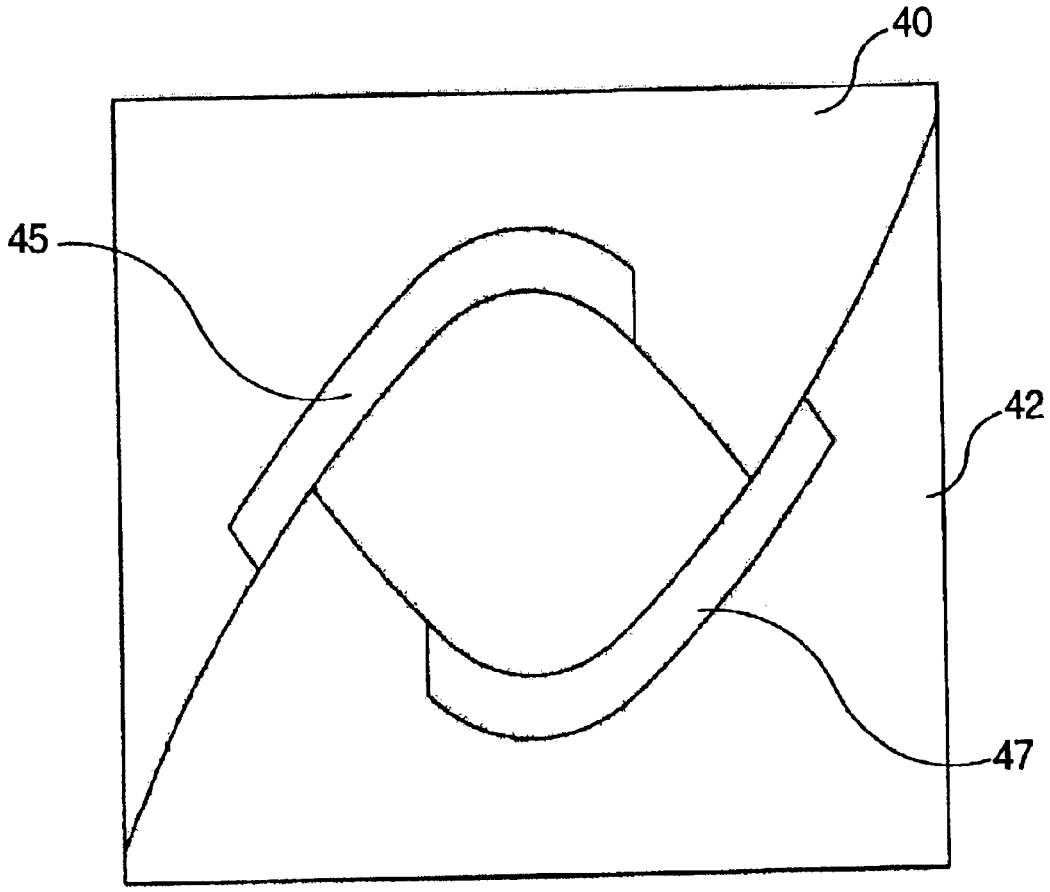
FIG. 9 represents a second embodiment of the guillotine mechanism.

The side edges of the guillotines may be rectilinear in shape as in the embodiment represented in FIGS. 8A and 8B. They may instead be curved in shape to fit even better the shape of the cable and to soften the coverage angle between the two parts of the diaphragm as shown in FIG. 9. In the two embodiments, the recess of each guillotine formed by the side edges has a rounded shoulder 45 or 47 which extends along the side edge of each guillotine and which provides better pressure distribution on the cable.

Because of its geometric continuity, the interconnection device described above ensures homogenous transmission parameters between the cable and the connector interface block. It offers exceptional ease of use in the field, as no special tools are required to be inserted in a compact cavity as is the case of certain devices of the prior art. This function is fulfilled mainly by the closing lever of the dressing-block, which enables a large space to be opened before being folded down onto the conductors which were pre-positioned in the IDCs to ensure the electrical connection. Once the closing lever is pressed down, the assembly forms a cylinder adapted to be inserted into a cylindrical cavity, and thus to have a geometry identical to that resulting from the interconnection of the male and female connectors.

I claim:

1. A strain relief device for an electrical connector designed to be interconnected to another connector of the same type to connect two cables containing at least one twisted pair, wherein said at least one twisted pair has conductors connected in a connection block having elements by means of insulation displacement contacts to contact blades, adapted to ensure contact in an interface block having elements with the corresponding contact blades of the other connector, said strain relief device comprising two guillotines sliding in side grooves of said connection block, wherein the side edges of said guillotines form a 90° angle between them and a 45° angle in relation to the direction of movement of said guillotines during a clamping operation, such that the side edges of the two guillotines form a diaphragm when they approach one another;

wherein each guillotine includes racks on both of its edges that block the guillotine when it slides in said grooves;

wherein each guillotine includes a shoulder located in a recess formed by said side edges and extending along a side edge of the guillotine; and wherein, when a connection is made, the geometry of the elements comprising said connection block is the same as the geometry of the elements comprising said interface block, said geometry being adapted so that the differential mode impedance between the conductors of each pair and the common mode impedance between said conductors and the shielding of said pair are respectively equal to the differential mode impedance between said contact blades and the common mode impedance between said contact blades and the shielding of the connector.

2. The strain relief device according to claim 1, wherein said insulation displacement contacts and said contact blades are included in a dressing-block made of plastic material of cylindrical shape with a circular cross-section, said dressing-block being inserted into cavities of said connection block and said interface block, said cavities having conductive walls and a cylindrical shape with circular cross-section.

3. The strain relief device according to claim 2, wherein said cavities into which said dressing-block is inserted comprise a first cavity of a first diameter located in said interface block and a second cavity of a second diameter located in said connection block, both cavities having the same axis and being connected by a cavity having the shape of a truncated cone, wherein the second diameter is greater than the first diameter.

4. The strain relief device according to claim 3, wherein said connection block includes a rectangular cavity divided into four insulating sub-cavities by two orthogonal conductive walls ensuring the transition from the shielding between the cable part where the shielding of the pairs are in contact with the part of the cable where the pairs are separated.

5. The strain relief device according to claim 4, wherein the shielding of each pair ends in said second cylindrical cavity such that said rectangular cavity has no influence on the electrical parameters of the pair.

6. The strain relief device according to claim 5, wherein said dressing-block includes a closing lever which enables, when the closing lever is open, said contact blades to be installed before being connected to the conductors of the associated pair and to place said conductors encased in their insulating jacket into said insulation displacement contacts, the closure of said closing lever causing penetration of the sharp edges into said insulating jackets of said insulation displacement contacts connected electrically to said contact blades and thus enabling the electrical connection between said conductors and said contact blades to be made.

7. The strain relief device according to claim 6, wherein said sharp edges of the insulation displacement contacts form an integral part of said contact blades and are located at the end of said contact blades and transversally to said contact blades.

8. The strain relief device according to claim 7, wherein one of said contact blades is longer than the other of said contact blades so that, in order to preserve a distance between said contact blades defined by the differential mode impedance, said sharp parts located at the end of said blades are shifted to avoid mutual contact.

9. The strain relief device according to claim 8, wherein each of said contact blades includes a rectilinear part and a portion where contact takes place comprising a stiff side, a rounded bump, and an inclined plane, so that when connection is made between said connector and another connector of the same type, the electrical connection between the contact blades of both connectors is made by the contact between the rounded bumps of the blades.

10. The strain relief device according to claim 9, wherein each of said contact blades is placed in a groove of the front part of said dressing-block located in said interface block, said groove including a recess located at the location of said portion where contact occurs so that said blade occupies said recess during its deformation when the rounded bump of each of the contact blades passes behind the rounded bump of the other contact blade during the connection.

11. A strain relief device for an electrical connector designed to be interconnected to another connector of the same type to connect two cables containing at least one twisted pair, wherein said at least one twisted pair has conductors connected in a connection block having elements by means of insulation displacement contacts to contact blades, adapted to ensure contact in an interface block having elements with the corresponding contact blades of the other connector, said strain relief device comprising two guillotines sliding in side grooves of said connection block, wherein the side edges of said guillotines form a 90° angle between them and a 45° angle in relation to the direction of movement of said guillotines during a clamping operation, such that the side edges of the two guillotines form a diaphragm when they approach one another;

wherein each guillotine includes racks on both of its edges that block the guillotine when it slides in said grooves;

wherein each guillotine includes a shoulder located in a recess formed by said side edges and extending alone a side edge of the guillotine;

wherein, when a connection is made, the geometry of the elements comprising said connection block is the same as the geometry of the elements comprising said interface block, said geometry being adapted so that the differential mode impedance between the conductors of each pair and the common mode impedance between said conductors and the shielding of said pair are respectively equal to the differential mode impedance between said contact blades and the common mode impedance between said contact blades and the shielding of the connector;

wherein said insulation displacement contacts and said contact blades are included in a dressing-block made of plastic material of cylindrical shape with a circular cross-section, said dressing-block being inserted into cavities of said connection block and said interface block, said cavities having conductive walls and a cylindrical share with circular cross-section;

wherein said cavities into which said dressing-block is inserted comprise a first cavity of a first diameter located in said interface block and a second cavity of a second diameter located in said connection block, both cavities having the same axis and being connected by a cavity having the shape of a truncated cones wherein the second diameter is greater than the first diameter;

wherein said connection block includes a rectangular cavity divided into four insulating sub-cavities by two orthogonal conductive walls ensuring the transition from the shielding between the cable part where the shielding of the pairs are in contact with the part of the cable where the pairs are separated;

wherein the shielding of each pair ends in said second cylindrical cavity such that said rectangular cavity has no influence on the electrical parameters of the pair;

wherein said dressing-block includes a closing lever which enables, when the closing lever is open, said contact blades to be installed before being connected to the conductors of the associated pair and to place said conductors encased in their insulating jacket into said insulation displacement contacts, the closure of said closing lever causing penetration of the sharp edges into said insulating jackets of said insulation displacement contacts connected electrically to said contact blades and thus enabling the electrical connection between said conductors and said contact blades to be made;

wherein said share edges of the insulation displacement contacts form an integral part of said contact blades and are located at the end of said contact blades and transversally to said contact blades;

wherein one of said contact blades is no longer than the other of said contact blades so that, in order to preserve a distance between said contact blades defined by the differential mode impedance, said sharp parts located at the end of said blades are shifted to avoid mutual contact;

wherein each of said contact blades includes a rectilinear part and a portion where contact takes place comprising a stiff side, a rounded bump, and an inclined plane, so that when connection is made between said connector and another connector of the same type, the electrical connection between the contact blades of both connectors is made by the contact between the rounded bumps of the blades;

wherein each of said contact blades is placed in a groove of the front part of said dressing-block located in said interface block, said groove including a recess located at the location of said portion where contact occurs so that said blade occupies said recess during its deformation when the rounded bump of each of the contact blades passes behind the rounded bump of the other contact blade during the connection; and wherein each of said contact blades has a constant thickness (T), and has an initial width (W) in its rectilinear part and a narrower second width (Wc) in the portion where contact is made with the corresponding portion of the contact blade of the other connector such that the common mode impedance is equal to:

$$Zc = \frac{60}{\sqrt{\varepsilon r}} \mathrm{Ln}\left(\frac{1.9B}{0.8W + T}\right)$$

where B=2H+T with H being the distance between the middle point of the base of the blade and the wall of the cavity, and is the same in the rectilinear part and in the portion where the contact takes place when Wc=W−1.25 T.

* * * * *